US009719283B2

(12) United States Patent
Holzapfel

(10) Patent No.: US 9,719,283 B2
(45) Date of Patent: Aug. 1, 2017

(54) ACTUATING DRIVE FOR FURNITURE FLAPS

(71) Applicant: Julius Blum GmbH, Hoechst (AT)

(72) Inventor: Andreas Holzapfel, Bregenz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/218,183

(22) Filed: Jul. 25, 2016

(65) Prior Publication Data

US 2016/0333620 A1 Nov. 17, 2016

Related U.S. Application Data

(63) Continuation of application No. PCT/AT2015/000005, filed on Jan. 19, 2015.

(30) Foreign Application Priority Data

Mar. 13, 2014 (AT) ..... A 179/2014

(51) Int. Cl.
*E05F 1/12* (2006.01)
*E05F 1/10* (2006.01)
*A47B 96/00* (2006.01)

(52) U.S. Cl.
CPC ..... *E05F 1/1253* (2013.01); *A47B 96/00* (2013.01); *E05F 1/105* (2013.01); *E05F 1/1058* (2013.01); *E05Y 2201/618* (2013.01)

(58) Field of Classification Search
CPC ..... F05F 1/1253; F05F 1/1246; F05F 1/105; F05F 1/1058
See application file for complete search history.

(56) References Cited

U.S. PATENT DOCUMENTS 8,321,996 B2 * 12/2012 Hirtsiefer ..... E05D 3/14 16/286
9,464,473 B2 * 10/2016 Baldreich ..... E05F 1/1058
(Continued)

FOREIGN PATENT DOCUMENTS

AU 2008248881 11/2008
AU 2008248882 11/2008
(Continued)

OTHER PUBLICATIONS

Search Report issued Nov. 28, 2014 in Austrian Application No. A 179/2014.
(Continued)

*Primary Examiner* — Daniel Rohrhoff
(74) *Attorney, Agent, or Firm* — Wenderoth, Lind & Ponack, L.L.P.

(57) ABSTRACT

An actuating drive for moving a flap of an item of furniture, including: an actuating arm pivotally mounted about a pivoting axis for moving the flap, a spring device for applying a force onto the actuating arm, a transmission mechanism for transmitting a force of the spring device onto the actuating arm in a closing direction and for transmitting a force of the spring device onto the actuating arm, and an adjusting device for adjusting a position of an actuating portion of the actuating drive in or along a guide. The actuating drive includes a coupling device coupling the spring device, the pivoting axis of the actuating arm, and the actuating portion to one another. By adjusting the actuating portion in or along the guide, the position of the dead-center of the actuating arm and the force of the spring device acting towards the opening direction can be variably adjusted.

14 Claims, 9 Drawing Sheets

(56) References Cited

U.S. PATENT DOCUMENTS

| | | | | |
|---|---|---|---|---|
| 2001/0039762 | A1 | 11/2001 | Giovannetti | |
| 2008/0121490 | A1 | 5/2008 | Dubach et al. | |
| 2010/0162847 | A1 | 7/2010 | Gassner | |
| 2010/0229672 | A1 | 9/2010 | Brunnmayr | |
| 2011/0138960 | A1 | 6/2011 | Omann et al. | |
| 2012/0032570 | A1 | 2/2012 | Friesenecker et al. | |
| 2012/0161598 | A1* | 6/2012 | Blum | E05F 1/1276 312/319.2 |
| 2013/0333291 | A1* | 12/2013 | Blum | E05F 1/1058 49/386 |
| 2014/0317883 | A1 | 10/2014 | Baldreich | |
| 2016/0160551 | A1* | 6/2016 | Lutz | E05D 11/1064 74/469 |
| 2016/0168896 | A1* | 6/2016 | Holzapfel | E05D 15/401 16/287 |
| 2016/0376823 | A1* | 12/2016 | Huber | E05F 1/1058 312/319.2 |

FOREIGN PATENT DOCUMENTS

| | | |
|---|---|---|
| CN | 101091034 | 12/2007 |
| CN | 101680253 | 3/2010 |
| CN | 101688412 | 3/2010 |
| CN | 101809245 | 8/2010 |
| CN | 101883907 | 11/2010 |
| CN | 102131998 | 7/2011 |
| CN | 102405327 | 4/2012 |
| DE | 26 48 085 | 4/1978 |
| DE | 102 03 269 | 8/2003 |
| DE | 10 2004 019 7 | 11/2005 |
| EP | 1 154 109 | 11/2001 |
| EP | 1 990 494 | 11/2008 |
| WO | 2013/113047 | 8/2013 |

OTHER PUBLICATIONS

Search Report issued Apr. 12, 2017 in corresponding Chinese Application No. 201580012651.5.

* cited by examiner

ACTUATING DRIVE FOR FURNITURE FLAPS

BACKGROUND OF THE INVENTION

The present invention relates to a furniture drive for moving a flap of an item of furniture, including: at least one pivotally mounted actuating arm for moving the flap, a spring device for acting a force onto the actuating arm, a transmission mechanism for transmitting a force of the spring device onto the actuating arm in a closing direction and, after exceeding a dead-center position, for transmitting a force of the spring device onto the actuating arm in an opening direction, and an adjusting device by way of which a position of an actuating portion of the actuating drive can be adjusted in or along a guide.

The invention further concerns an arrangement with a flap of an item of furniture and with an actuating drive of the kind to be described.

Actuating drives of this kind can include a lever arrangement in the function of a dead-center mechanism (DE 102 03 269 A1). The spring device applies a closing force onto the actuating arm in a region near to the closed position and, after exceeding a dead-center position in which the hinge axes of the levers and the acting force vectors are in line, applies a torque towards the opening direction. Also known are dead-center mechanisms having an arrangement with a control curve and a pressure roller (DE 10 2004 019 785 A1), whereby the control curve is shaped such that the change of the torque acting onto the actuating arm is effected after having passed a dead-center position.

The force of the spring device is to be adjusted by an adjusting device according to the weight of the furniture flap to be moved, i.e. that the spring device has to exert a corresponding high torque onto the actuating arm in the opening direction when heavy furniture flaps are to be moved. With actuating drives having a dead-center mechanism, the adjustment also affects the closing force of the actuating arm which leads to the fact that the furniture flap, when a high torque acts onto the actuating arm in the opening direction, is also held with a corresponding high closing force in the closed position. The high closing force needs to be overcome by a considerable manual force applied by an operator when opening the flap until the dead-center position of the actuating arm is reached, whereupon the spring device assists the further opening movement.

Such flap fittings are described in DE 102 03 269 A1, EP 1 154 109 A1 and in DE 26 48 085 A1.

A further development is shown in EP 1 990 494 A1, wherein an effective torque can be adjusted in order to assist the closing movement and, on the other hand, the opening movement.

WO 2013/113047 A1 to the applicant shows an actuating drive for furniture flaps, the actuating drive can be switched between different operating modes by a switching device. By way of the switching device, a hinge axis which connects two levers of the actuating drive with one another can be adjusted along a guide. In a first operating mode, a closing force is exerted onto the actuating arm in or near the closed position so that a furniture flap connected to the actuating arm, at the end of the closing movement, can be pulled into the closed end position. By a displacement of the hinge axis along the guide, on the contrary, an opening force is exerted onto the actuating arm in or near the closed position in a second operating mode, so that the actuating arm, although being in the closed position, acts towards the opening direction. This has the particular advantage that, in the second operating mode, an additional ejection device for ejecting the flap starting from a closed position into an opening position needs not to overcome a closing force of the spring device exerted onto the actuating arm so that the furniture flap can also be ejected from the closed end position by way of a relatively low dimensioned force storage accumulator of the ejection device. For adjusting the spring force acting towards the opening direction, there is provided an adjustment device (FIG. 2, reference number 15) which is separate from the switching device. For the assembling person, there is thus the necessity that two separate adjustments need to be performed.

SUMMARY OF THE INVENTION

It is an object of the invention to provide an actuating drive with an easy adjustment possibility, wherein there can be achieved a reduced closing force of the actuating arm in the closed position, even when having high torques acting towards the opening direction.

According to the invention, it is thus provided that the actuating drive includes a coupling device which couples the spring device, the pivoting axis of the actuating arm and the actuating portion to one another. By adjusting the actuating portion in or along the guide, the position of the dead-center of the actuating arm as well as the force of the spring device acting towards the opening direction onto the actuating arm can be variably adjusted, so that upon an increase of the force acting towards the opening direction, also the pivoting angle of the actuating arm, at which the position of the dead center lies, can be reduced.

In other words, by way of a single adjustment device, the pivoting angle of the actuating arm, at which the dead center lies, can be reduced and can be thus displaced in a direction closer to the opening angle of 0°, which corresponds to the closed end position of the furniture flap. By way of a phase shift of the torque progression by a predetermined amount in a direction towards the closed end position of the actuating arm effected thereby, a lower and more uniform acting closing force in the closed end position of the flap can be obtained, even when high pre-stressing forces act towards the opening direction (see description of FIG. 1).

The guide can have, at least partially, substantially a straight form and/or an at least partially curved form. By the geometric choice of the guide, which includes a horizontal component as well as a vertical component in the mounted position, the choice of the slope of the guide determines to what extent the adjustment of the dead center position and the adjustment of the spring force acting in the opening direction are effected. The horizontal component determines the torque onto the actuating arm acting in the opening direction, the vertical component of the guide determines, on the contrary, the dead-center position of the actuating arm. Under the exemplary assumption that the guide is formed as a straight line having a slope of 45°, a displacement of the actuating portion in or along the guide would cause a ratio of 1 to 1, so that the adjustment of the dead center position and the adjustment of the torque acting in the opening direction are each effected to the same extent.

In this connection, upon an actuation of the adjustment device, the adjustment of the position of the dead-center of the actuating arm and the adjustment of the force of the spring device acting onto the actuating arm in the opening direction can be effected at the same time. This is however dependent on the respective shape of the guide. When the actuating portion, upon its adjustment in or along the guide, solely interacts with a horizontal component of the guide in the mounting position, only the force of the spring device acting in the opening direction onto the actuating arm is varied, without the dead-center position being changed thereby. On the contrary, when the actuating portion, upon its adjustment in or along the guide, interacts with a vertical component of the guide in the mounted position, then the position of the dead-center is also adjusted therewith.

According to an embodiment, the position of the dead-center of the actuating arm—starting from the fully closed position of the actuating arm—can be adjusted between 10° and 30°, preferably between 15° and 25°.

BRIEF DESCRIPTION OF THE DRAWINGS

Further details and advantages of the present invention will be explained by way of the embodiments shown in the Figures, wherein.

DETAILED DESCRIPTION OF THE INVENTION

Figure 1:
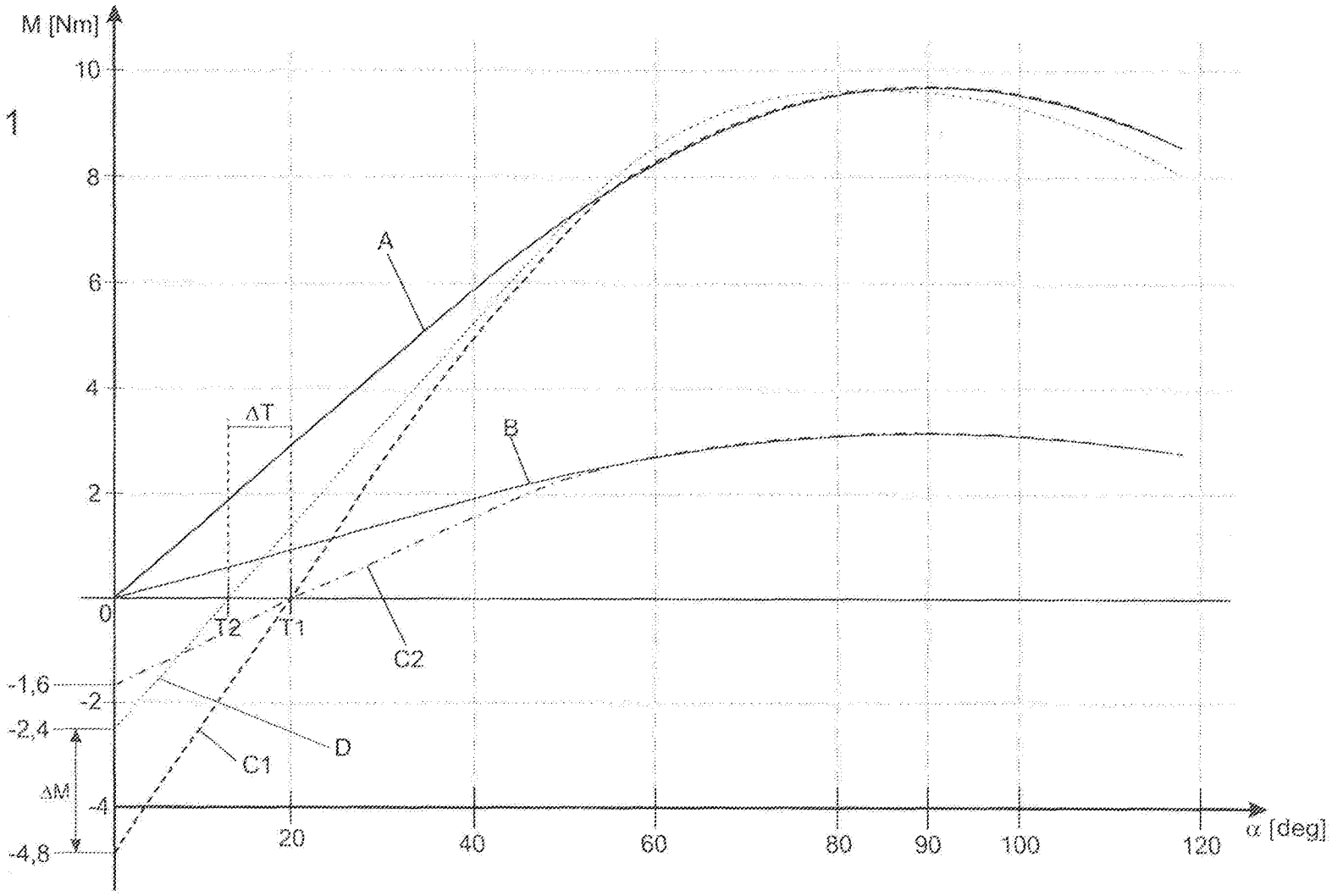
FIG. 1 shows a graph of the torque progressions depending on the opening angle of the flap.

FIG. 1 shows a graph of the torque progressions (torque M expressed in Newton meters, Nm) depending on the opening angle (expressed in degrees, α) of the flap 3 of an item of furniture 1. Curve A shows the (theoretical) torque progression (to be exerted by the actuating drive 4) dependent on the angular position of the flap 3, wherein the flap 3 is neither accelerated towards the opening direction nor towards the closing direction and is thus held in balance. The curve A corresponds to the maximal adjustment of the torque in the opening direction which is thus to be provided when heavy furniture flaps 3 are to be moved. Starting from an opening angle of 0° of the flap 3, the latter is being opened over an opening angle range, wherein the maximum of the curve A lies approximately at 90° opening angle of the flap 3. With 90° opening angle of the flap 3, the actuating drive 4 has to provide the highest torque so that the flap 3 is held in place in this position by the force of the spring device 8.

Curve B shows the (theoretical) torque progression (to be exerted by the actuating drive 4) dependent on the angular position of the flap 3, wherein the flap 3 is neither accelerated towards the opening direction nor towards the closing direction and is thus held in balance. The curve B corresponds to the minimal adjustment of the torque in the opening direction which is thus to be provided when lightweight furniture flaps 3 are to be moved. The maximum of the curve B also lies at 90° opening angle of the flap 3, wherein the provided torque of the actuating drive 4 is less than the one according to curve A.

Curve C1 shows the progression of the torque exerted by the actuating drive 4 onto the actuating arm 5 and therewith exerted onto the flap 3. This curve corresponds to the maximal adjustment of the torque in the opening direction (when heavy flaps 3 are to be moved), wherein for greater opening angles—without consideration of the friction—an approximation towards curve A can be achieved, starting from an opening angle of the flap 3 of about 40°. In the fully closed position (with an opening angle of 0°), a negative force is exerted onto the flap 3 so that the flap 3 is held with a closing force in the closed end position. After exceeding a dead-center position T1, the flap 3 is acted by a high torque towards the opening direction. When the flap 3 is again closed, the actuating drive 4, after having passed the dead-center position T1, exerts a high closing force (−4.8 Nm) onto the flap 3 due to the high torque acting towards the opening direction. The high closing force must be overcome each time by an operator by applying a strong pulling force onto the flap 3.

Curve C2 shows the progression exerted by the actuating drive 4 onto the actuating arm 5 and thus the torque exerted onto the flap 3 with a minimal adjustment of the torque acting in the opening direction, which is therefore to be provided when lightweight flaps 3 are to be moved. This low torque in the opening direction, after having passed the dead center T1, also causes a low closing force (−1.6 Nm) which can be easily overcome by an operator without great effort when opening the flap 3. It is visible that, upon an adjustment of the minimal and maximal spring force (curve A and curve C2), there is a considerable difference of the closing force (namely −1.6 Nm and −4.8 Nm) which is a disadvantage for a person who needs open the flap 3.

The invention is now based on the general concept to adjust the position of the dead-center of the actuating arm 5, so that the location of the dead-center T1 is adjusted further in a direction towards the closed position of the flap 3 and is now positioned on dead-center T2. Curve D shows the progression of torque of the actuating drive 4 with the maximal spring force acting in the opening direction (i.e. when using heavy flaps 3). When now the flap 3 is closed, the actuating arm 5 passes through the dead-center T2, wherein by way of the displaced position of the dead-center T2, the diagram enables to see that the closing force, with an opening angle of 0° (however with the same high level of torque acting in the opening direction as curve C2) is considerably reduced by the force difference ΔM (−2.4 Nm instead of −4.8 Nm, thus reduced by half). Accordingly, by way of an adjusted position of the dead-center starting from dead-center T1 to dead-center T2, a phase shift of the torque progression (curve D instead of curve C1) by an amount ΔT is effected so that in the closed position of the flap 3 (with an opening angle of 0° of the flap 3), a low closing force results even when there is a high torque acting in the opening direction, and the closing force can be easily overcome by a person when opening the flap 3. The phase shift of the torque progression of the curves C1, D by the amount ΔT can also be clearly seen with an opening angle of 90° of the flap 3.

Figure 2A:
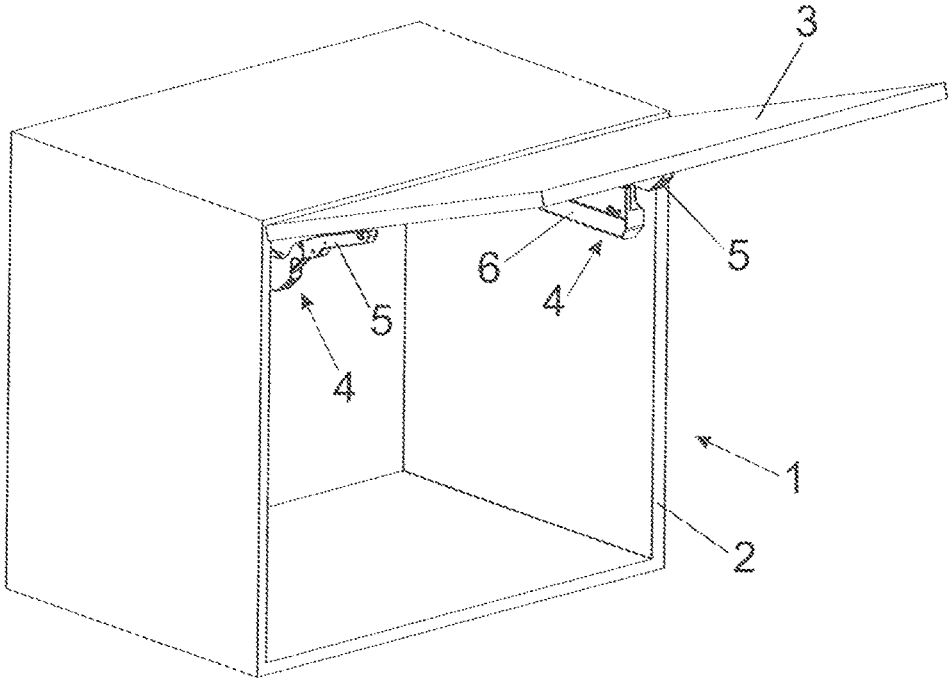
FIG. 2*a*, 2*b* show a perspective view of an item of furniture having a furniture carcass and a flap which can be moved upwardly movable thereto by way of actuating drives, and an actuating drive in a perspective view.

FIG. 2*a* shows an item of furniture 1 with a furniture carcass 2 and an upwardly movable flap 3 which is movably supported by actuating drives 4. In the shown embodiment, two actuating drives 4 are mounted on opposing side walls of the furniture carcass 2. The actuating drives 4 each have a housing 6 and at least one actuating arm 5 protruding from the housing 6, the actuating arm 5 is pivotally supported about a horizontally extending pivoting axis 13 in the mounted position and is connected to the flap 3. By way of the actuating drives 4, the flap 3 can be moved, starting from a vertical closed position, into an open position which lies above the furniture carcass 2.

Figure 2B:
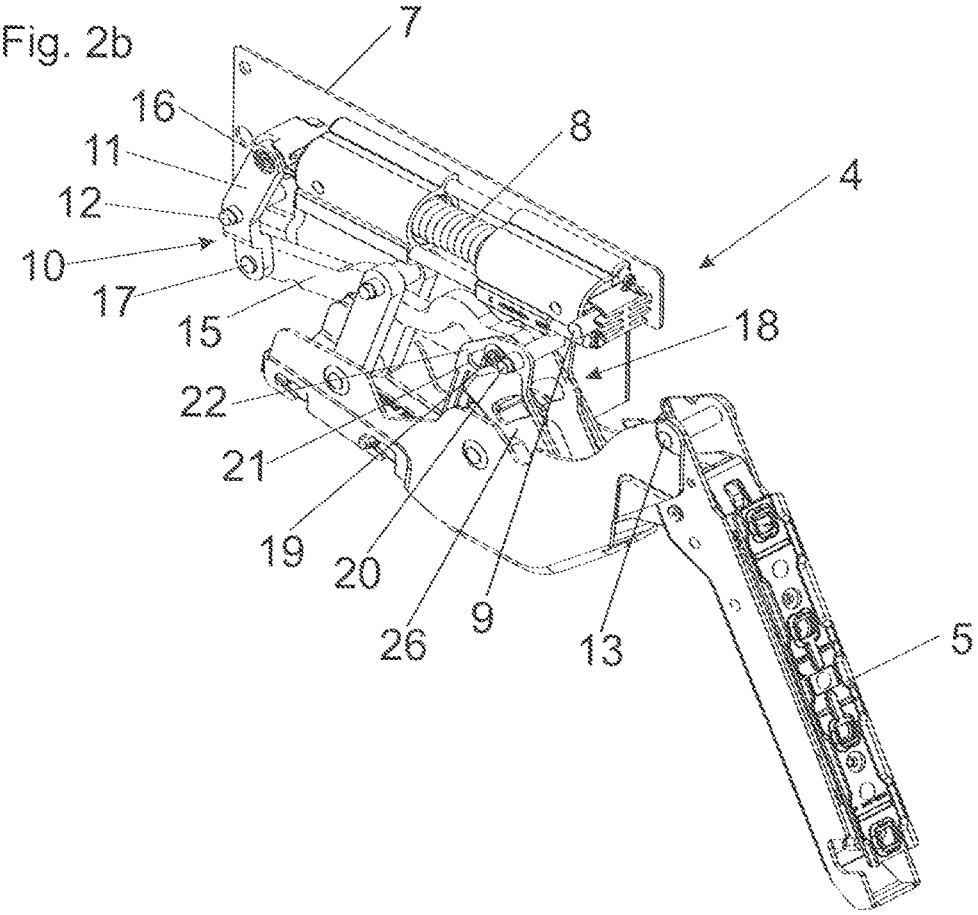

FIG. 2*b* shows a possible embodiment of an actuating drive 4 in a perspective view. On a base plate 7 to be fixed to the furniture carcass 2, one end region of a spring device 8 (preferably with one or several pressure springs) is stationarily supported on a spring basis 9. For transmitting a force from the spring device 8 onto the actuating arm 5 which is pivotable about pivoting axis 13, a transmission mechanism 10 is provided which includes a two-armed deflection lever 11 which is pivotally mounted about a stationary pivoting axis 12, the two-armed deflection lever 11 having two lever ends. A first lever end of the two-armed deflection lever 11 is connected to the spring device 8 via a first joint 16, a second lever end of the deflection lever 11 is connected to a pushing lever 15 via a second joint 17. On an end of the pushing lever 15 facing away from the joint 17, an actuating portion 19 is arranged. Further provided is a coupling device 18 which couples the spring device 8, the pivoting axis 13 of the actuating arm 5 and the actuating portion 19 to one another.

In the shown embodiment, the coupling device 18 includes a lever 22 having a guide 21, the lever 22 is pivotable about a stationary hinge axis 20. In or along the guide 21, a position of the actuating portion 19 can be adjusted by way of an adjusting device 23 (not shown here), so that by adjusting the actuating portion 19 in or along the guide 21, the position of the dead-center T1, T2 of the actuating arm 5 as well as the force of the spring device 8 acting onto the actuating arm 5 in the opening direction can be variably adjusted. In the shown Figure, the actuating portion 19 is located in a position adjacent to the stationary hinge axis 20 of the lever 22, so that the lever arm formed between the hinge axis 20 and the actuating portion 19 results small and thus the torque acting onto the actuating arm 5 in the opening direction is set to minimum. This adjustment of the actuating portion 19 relative to the guide 21 is thus provided for moving lightweight furniture flaps 3 and corresponds to curve C2 according to FIG. 1.

Figure 3A:
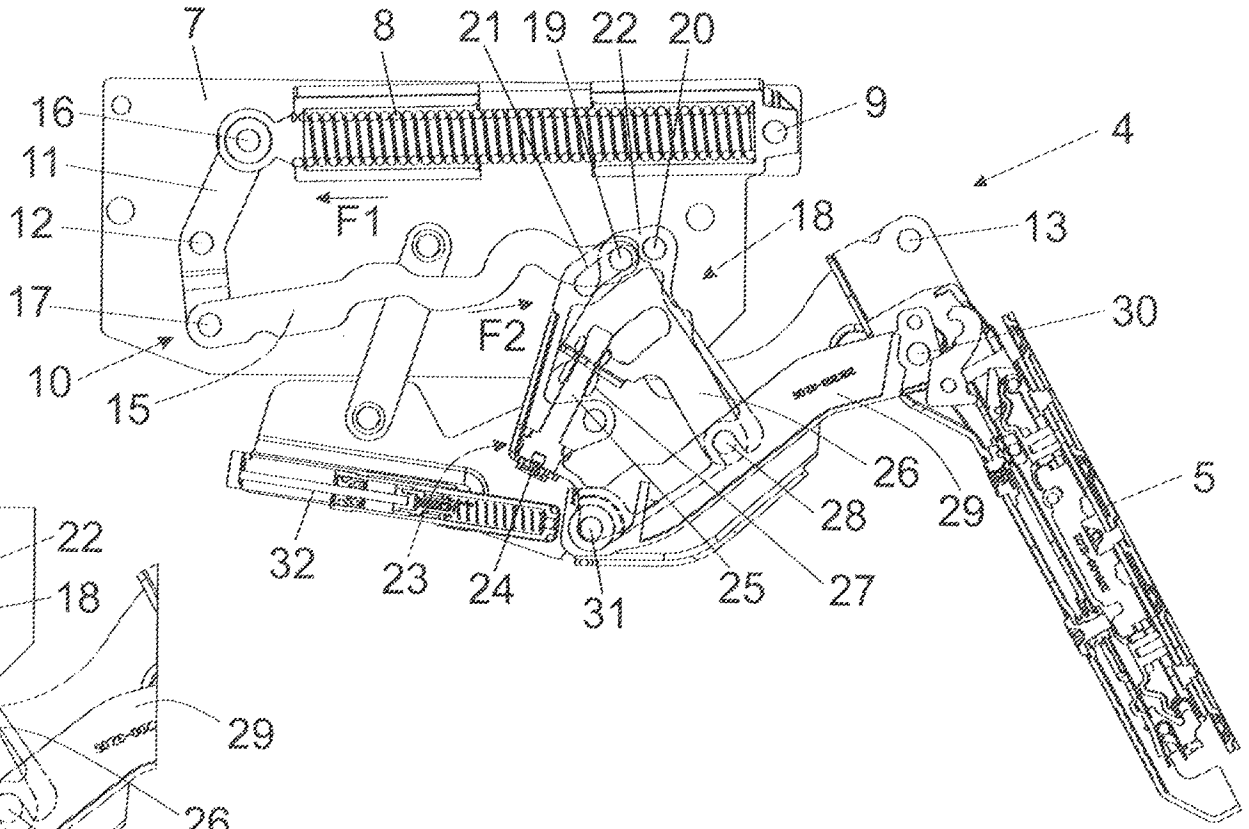
FIG. 3*a*, 3*b* shows the actuating drive according to FIG. 2*b* in a cross-section and an enlarged detail view thereof.

FIG. 3*a* shows the actuating drive 4 in a cross-section, wherein on the base plate 7, the spring device 8 is supported on the spring basis 9. The spring device 8 presses with a force F1 against the two-armed deflection lever 11. The spring device 8 is connected via a joint 16 with a first lever end of the deflection lever 11, wherein the joint 16 is non-adjustably arranged relative to the stationary axis 12 of the deflection lever 11. Thus, the distance between the joint 16 (onto which the spring device 8 acts onto) and the stationary pivoting axis 12 of the deflection lever 11 cannot be varied. This has the particular advantage that for adjusting the spring force, no displacement path for the spring device 8 relative to the pivoting axis 12 of the deflection lever 11 has to be provided. In particular, the arrangement of voluminous threaded spindles can be omitted, whereby the actuating drive 4 can assume a very compact structure. The second lever end of the deflection lever 11 is connected to the pushing lever 15 via a joint 17, and the pushing lever 15 is pushed in a direction of force F2 by the force of the spring device 8. The lever 22 of the coupling device 18 is pivotally mounted about a stationary hinge axis 20, wherein the position of the actuating portion 19 can be adjusted in or along the guide 21 by way of an adjustment wheel 24 of the adjusting device 23. The adjustment wheel 24 can have an adapter for receiving an actuating tool. By rotating the adapter by way of the actuating tool, the position of the actuating portion 19 relative to the guide 21 can be adjusted. The adjustment wheel 24 is provided with a threaded section 25 which is in engagement with a mounting thread 27 of an adjusting lever 26. For compensating lateral forces, the mounting thread 27 is movably arranged on the lever 26. The adjusting lever 26 is on the one hand connected to the actuating portion 19, on the other hand connected to an intermediate lever 29 via a moving hinge axis 28 which is in turn connected to the actuating arm 5 via a joint 30.

Figure 3B:
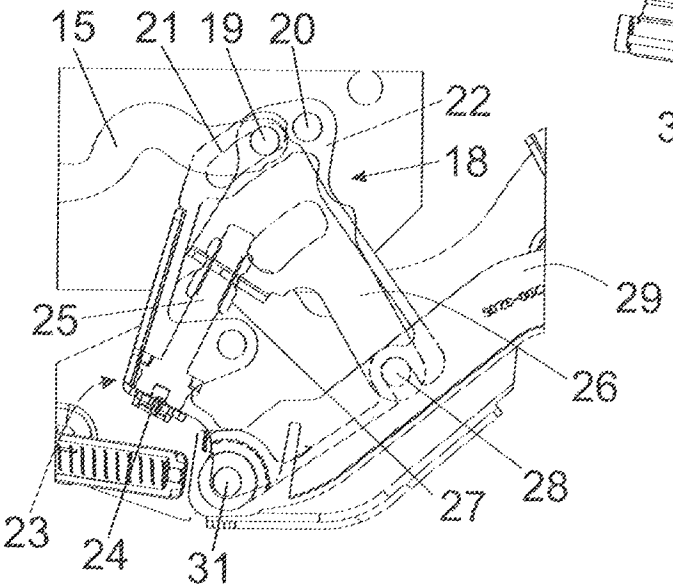

FIG. 3*b* shows the coupling device 18 with the adjustment device 23 in an enlarged view. By way of a rotation of the adjusting wheel 24 performed by a person, the adjusting lever 26 which is pivotally mounted about the moving hinge axis 28, together with the actuating portion 19, is pivotable relative to the lever 22, so that the position of the actuating portion 19 in or along the guide 21 of the lever 22 can be variably adjusted. By way of the adjusting device 23, the location of the actuating portion 19 can be adjusted in a direction towards and away from the hinge axis 20 of the lever 22, wherein the relative distance between the actuating portion 19 and the hinge axis 20 of the lever 22 in a direction X (FIG. 4) along a notional connecting line 35 between the actuating portion 19 and the hinge axis 20 of the lever 22 can be reduced or enlarged. In this way, the force of the spring device 8 acting onto the actuating arm 5 in the opening direction can be adjusted. Moreover, the location of the actuating portion 19, in a direction Y transverse to said notional connecting line 35, can be adjusted by way of the adjusting device 23, whereby the position of the dead-center T1, T2 of the actuating arm 5 can be variably adjusted. The lever 22 of the coupling device 18 is, on the one hand, pivotable about the stationary hinge axis 20 and, on the other hand, is connected to the intermediate lever 29 via the moving hinge axes 31 and 28. By way of a damping device 32 (FIG. 3*a*) which is formed as a fluid damper having a piston-cylinder-unit, the last closing path of the actuating arm 5 towards the fully closed end position can be dampened. At the end of the closing movement, the hinge axis 31 abuts against the piston of the damping device 32 and displaces the piston against the resistance of a damping fluid relative to the cylinder.

Figure 4:
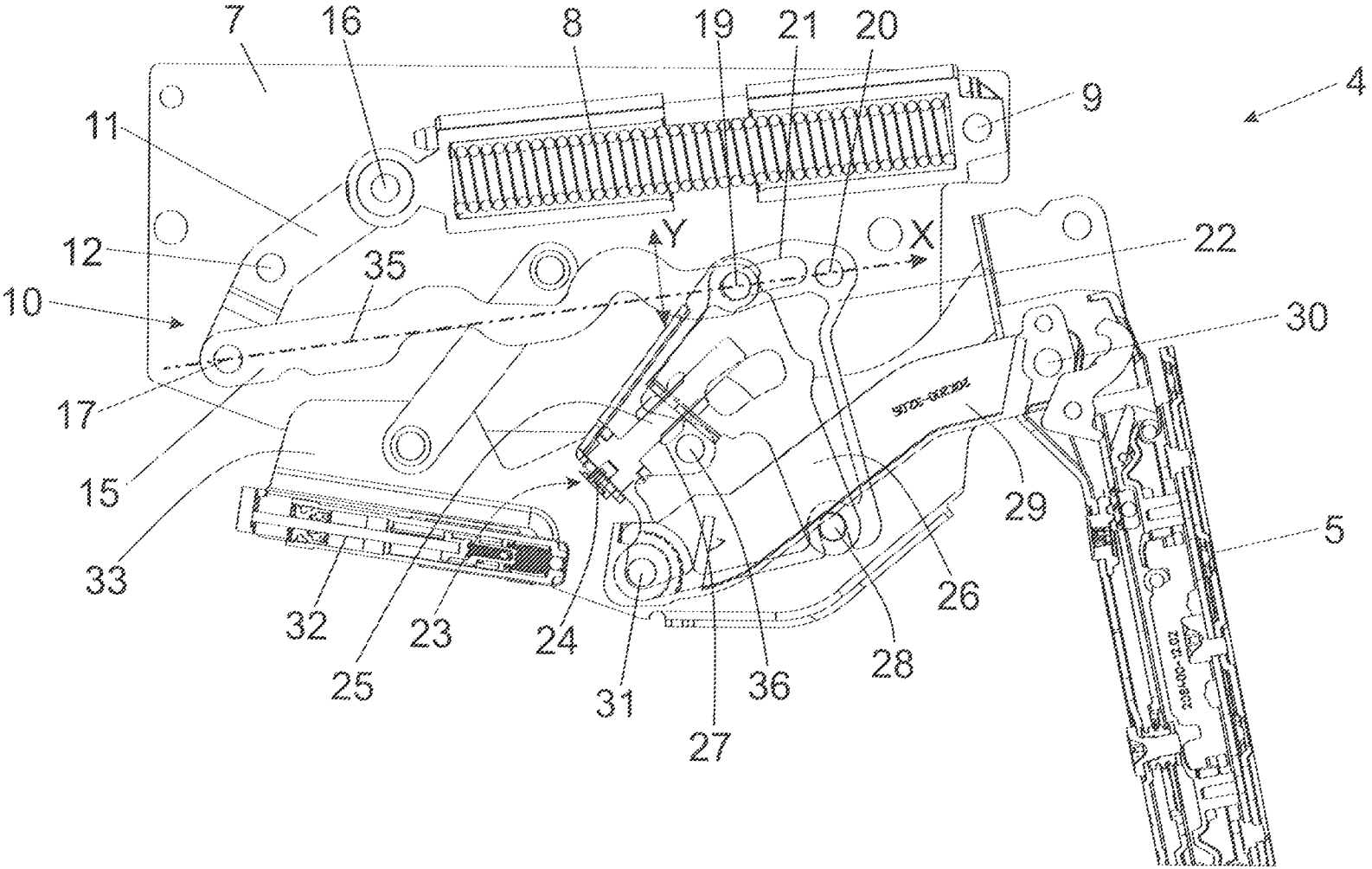
FIG. 4 shows the actuating drive in a cross-section, wherein the actuating portion has been displaced in or along the guide.

FIG. 4 shows a cross-section of the actuating drive 4, wherein by rotating the adjustment wheel 24 of the adjustment device 23, the actuating portion 19 has been displaced to the other end of the guide 21. In the shown Figure, the actuating arm 5 is located in a displaced dead-center position T2 in comparison with FIGS. 3*a* and 3*b*. In the shown dead-center position T2 of the actuating arm 5, the joint 17, the actuating portion 19 and the hinge axis 20 of the lever 22 are arranged on a common notional connecting line 35. The relative distance of the actuating portion 19 relative to the hinge axis 20 of the lever 22 has thereby been enlarged, so that the effective lever arm formed between the actuating portion 19 and the hinge axis 20 has been enlarged and thus the torque acting onto the actuating arm 5 in the opening direction has been increased. Moreover, the position of the actuating portion 19 is also adjustable in a direction Y transverse to the notional connecting line 35, so that besides the force of the spring device 8 acting in the opening direction, also the position of the dead-center T1, T2 of the actuating arm 5 can be adjusted. This adjustment of the actuating portion 19 relative to the guide 21 is thus used for moving heavy furniture flaps 3 and corresponds to the curve D according to FIG. 1.

The actuating drive 4 includes a longitudinally extending main lever 33 which is pivotally connected to the base plate 7 via a hinged lever 34. The main lever 33 is connected by way of the hinge axis 36 to the lever 22. The lever 22 is on the one hand pivotally mounted to the base plate 7 about the stationary axis 20 and on the other hand pivotally connected to the intermediate lever 29 by way of the moving axis 31. Moreover, the lever 22 is supported on the moving axis 28 about which the adjusting lever 26 is pivotally mounted. The intermediate lever 29 is connected to the actuating arm 5 by way of the joint 30.

Figure 5:
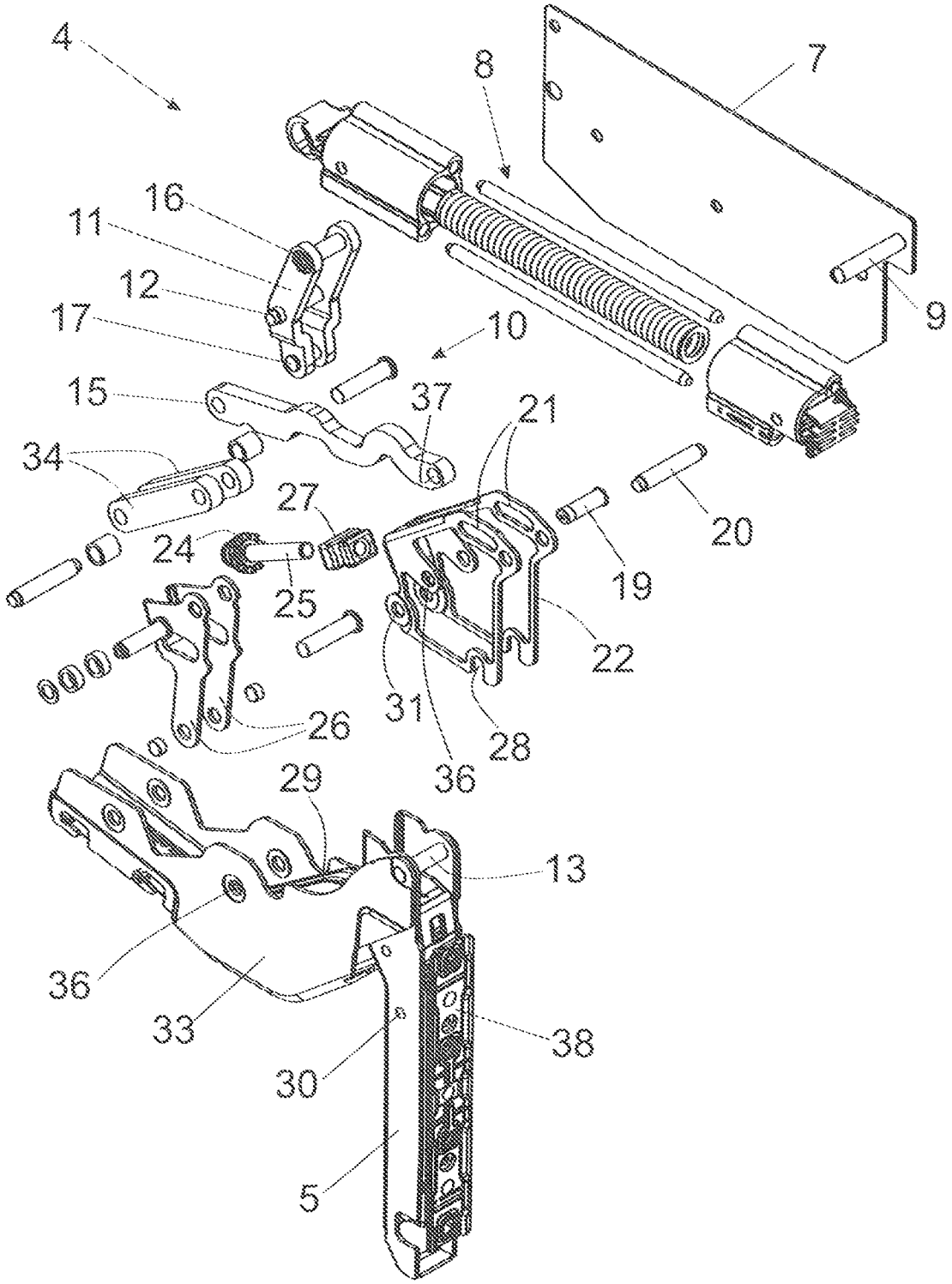
FIG. 5 shows the actuating drive in an exploded view.

FIG. 5 shows the actuating drive 4 in an exploded view. The spring device 8 is hingedly supported on the base plate 7 on a spring basis 9. The transmission mechanism 10 includes a two-armed deflection lever 11 which is pivotally mounted about the stationary axis 12, and the deflection lever 11 has two lever ends. A first lever end interacts with the spring device 8, and a second lever end interacts—directly or indirectly—with the adjustable actuating portion 19. In the shown embodiment, the spring device 8 is connected via a joint 16 to the first lever arm of the two-armed deflection lever 11 which is pivotally mounted about the pivoting axis 12. The second lever arm of the deflection lever 11 is connected via a further joint 17 to a multi-curved pushing lever 15. The pushing lever 15 has an opening 37 through which the actuating portion 19 in the form of a hinge pin reaches. The actuating portion 19 can be adjusted by an adjusting wheel 24 of an adjusting device 23 in or along, preferably continuously curved, guides 21 of the lever 22, so that the position of the engagement point of the pushing lever 15 on the lever 22 relative to the pivoting axis 20 of the lever 22 can be variably adjusted. The lever 22 and the adjusting lever 26 are connected to each other by the hinge axis 28. The mounting thread 27 for receiving the threaded section 25 of the adjusting wheel 24 is movably connected to the adjusting lever 26. The main lever 36 is connected via the hinge axis 36 to the lever 22. The intermediate lever 29 is on the one hand connected to the hinge axes 31 and 28 to the lever 22, on the other hand connected to the actuating arm 5 via the joint 30. A fitting 38 is to be mounted to the flap 3 of the item of furniture 1, and the actuating arm 5 can be releasably connected to the fitting 38 by way of a snap-connection. The actuating arm 5, starting from a dead-center located between both end positions of the flap 3, is on the one hand pressurized by the spring device 8 within a first pivoting range in a direction towards the outer end position, and on the other hand, starting from the dead-center position, is also pressurized by the spring device 8 within a second pivoting range in a direction towards the inner end position.

Figure 6:
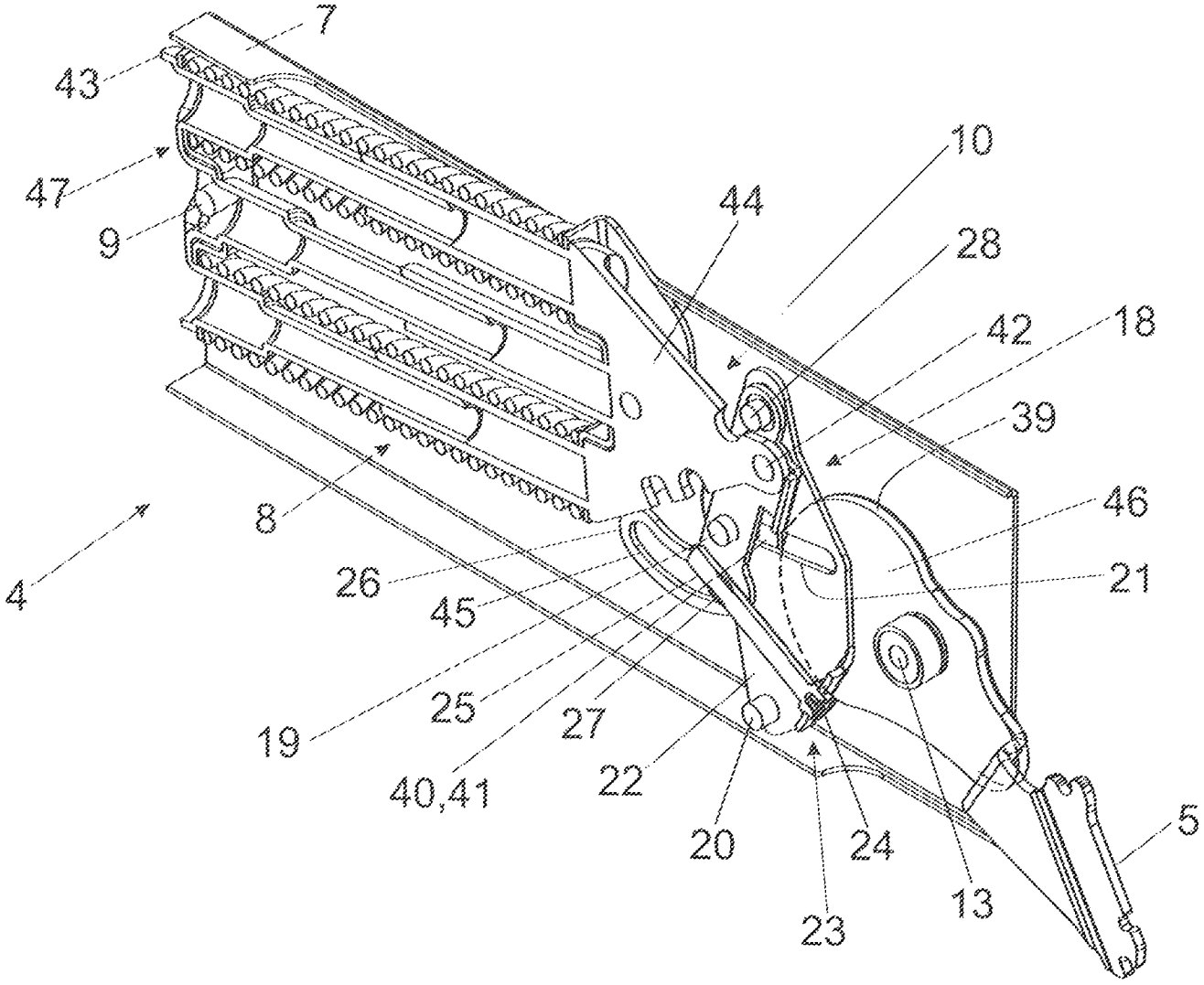
FIG. 6 shows a further embodiment of the actuating drive, wherein the actuating arm is pivotally mounted by way of an arrangement having a control curve and a pressure portion.

FIG. 6 shows an embodiment of an actuating drive 4 in a longitudinal cross-section, wherein the transmission mechanism 10 includes a actuating portion 46 which is movement-coupled to the actuating arm 5, a control curve 39 formed on the actuating portion 46 and a pressure portion 40 pressurized by the spring device 8. The pressure portion 40 can run along the control curve 39 of the actuating portion 46 upon a movement of the actuating arm 5. In the shown Figure, the pressure portion 40 is in the form of a pressure roller 41 which is rotatable about the actuating portion 19, the pressure roller 41 runs along the control curve 39 of the actuating portion 46 upon a movement of the actuating arm 5. The control curve 39 is formed by a peripheral surface of the actuating portion 46 being radially spaced from the pivoting axis 13. The control curve 39 is formed as a setting contour which influences the movement behavior of the flap 3 in terms of force, so that the rotatable pressure roller 41 exerts a torque depending on the pivoting position of the actuating arm 5. In the shown embodiment, the actuating portion 46, together with the actuating arm 5, is made in one piece, it is however also possible that the actuating portion 46 with the control curve 39 formed thereon can also be arranged on a different position along the acting force path formed between the spring device 8 and the actuating arm 5.

The spring device 8 includes a spring holder 47 having two portions 43, 44 which can be displaced relative to one another and between which several pressure springs 48 (FIG. 9) are accommodated. A first portion 43 of the spring holder 47 is supported on the spring basis 9, the spring-loaded portion 44 which is displaceable thereto is connected via a joint 42 to an adjusting lever 26 which is pivotally mounted about the moving hinge axis 28 on the lever 22 of the coupling device 18.

The coupling device 18 which couples the spring device 8, the pivoting axis 13 of the actuating arm 5 and the actuating portion 19 to one another includes a lever 22 which is pivotable about the stationary hinge axis 20, the lever 22 has a guide 21 along which the actuating portion 19 can be limitedly adjusted by an adjusting device 23. The actuating portion 19 with the rotatable pressure roller 41 mounted thereon is arranged on an adjusting lever 26 which is pivotally connected to the lever 22 by a moving hinge axis 28. By a rotational movement, effected by an actuating tool, of the adjusting wheel 24 of the adjusting device 23, the threaded portion 25 of an adjusting screw can be rotated, so that the mounting thread 27 can be moved along the threaded portion 25 and thus the pivoting position of the adjusting lever 26 relative to the lever 22 can be adjusted. By way of this adjustment of the actuating lever 26, also the position of the actuating portion 21 arranged thereon (and thus the position of the pressure roller 41) can be adjusted along the guide 21. The adjusting lever 26 has a contour 45 in the form of a curved elongated hole so that upon a pivoting movement of the actuating arm 5, the adjusting lever 26 with the pressure roller 41 can also be moved relative to the lever 22, i.e. the mounting thread 27 can be moved along the contour 45 of the adjusting lever 26 upon a movement of the actuating arm 5.

The dead-center of the transmission mechanism 10 is also determined by an apex point of the control curve 39, i.e. by the region of the control curve 39 which has the largest radial spacing in relation to the pivoting axis 13 of the actuating arm 5. By an adjustment of the actuating portion 19 with the pressure roller 41 mounted thereon, effected by way of the adjusting device 23, the position of the dead-center T1, T2 of the transmission mechanism 10 as well as the pre-stressing of the spring device 8 can be adjusted. The adjustment of the actuating portion 19 relative to the guide 21, as shown in FIG. 6, is used for moving lightweight furniture flaps 3 and corresponds to curve C2 according to FIG. 1.

Figure 7A:
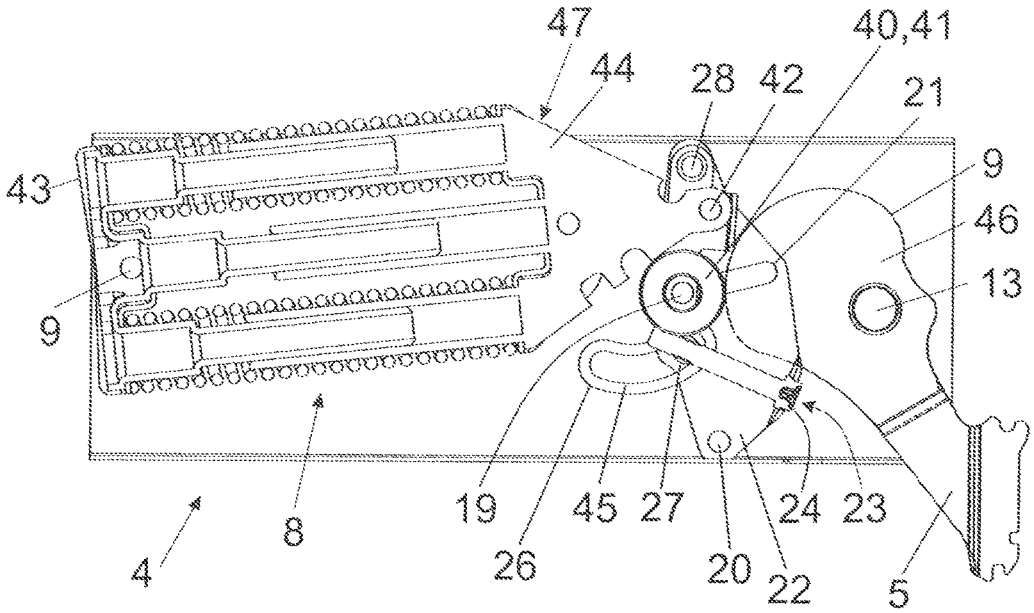
FIG. 7*a*, 7*b* are side views of the actuating drive according to FIG. 6 with the actuating portion in two different adjustment positions.
Figure 7B:
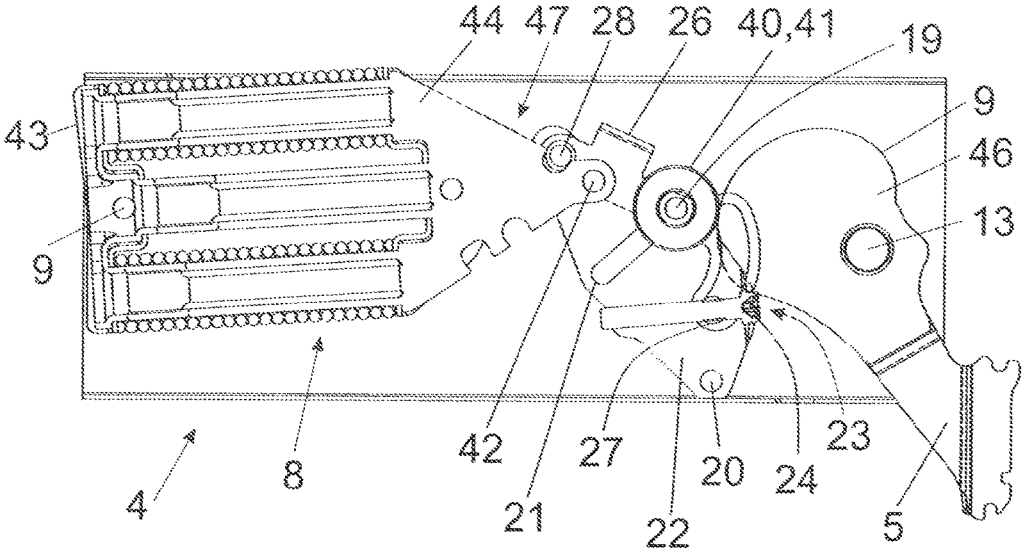

FIG. 7*a* and FIG. 7*b* show side views of the actuating drive 4 according to FIG. 6 with the actuating arm 5 in each case in the fully closed position. FIG. 7*a* shows the adjustment of the actuating portion 19 relative to the guide 21, wherein the adjustment is used for lightweight furniture flaps 3. The pre-stressing of the spring device 8 is thereby relatively low which can be seen by the intermediate spaces formed between the spring coils. FIG. 7*b*, on the contrary, shows the adjustment of the actuating portion 19 which is, in comparison with FIG. 7*a*, located on the other end of the guide 21. This adjustment of the actuating portion 19 relative to the guide 21 according to FIG. 7*b* is used for heavy furniture flaps 3. The pre-stressing of the spring device 8 is thereby very high which can be seen by the spring coils of the pressure springs 48 which directly rest against each other. By a direct comparison of the spring device 8 according to FIG. 7*a* and FIG. 7*b*, the different pre-stressing of the spring device 8 is clearly demonstrated.

Figure 8A:
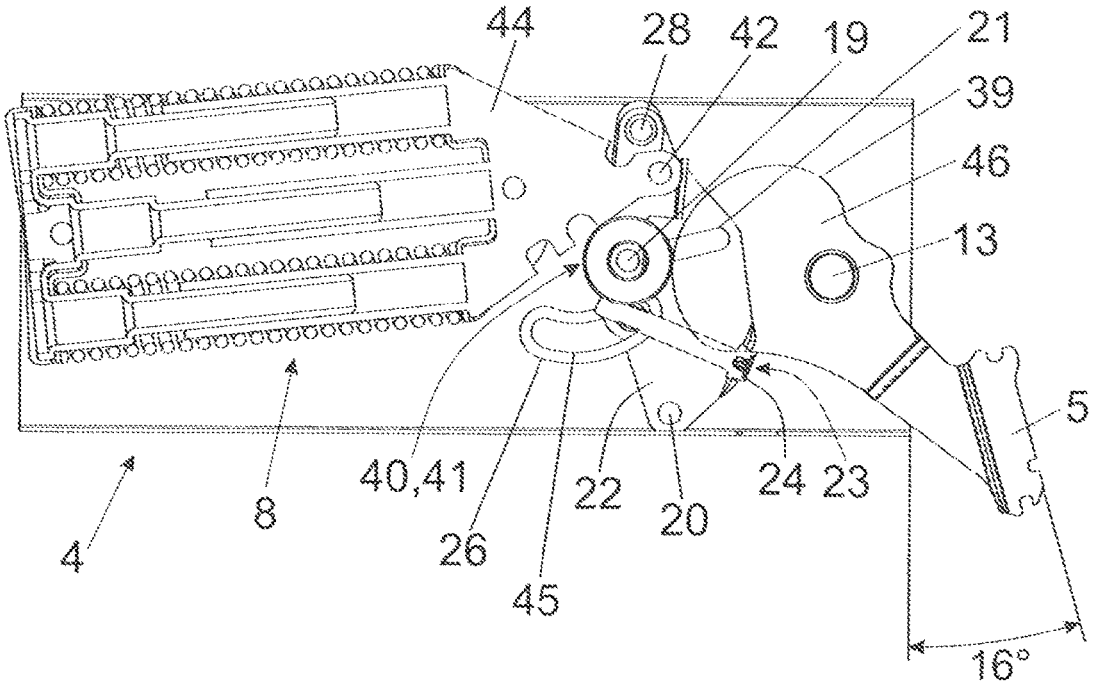
FIG. 8*a*, 8*b* are side views of the actuating drive with the actuating arm in two differently adjusted dead-center positions.
Figure 8B:
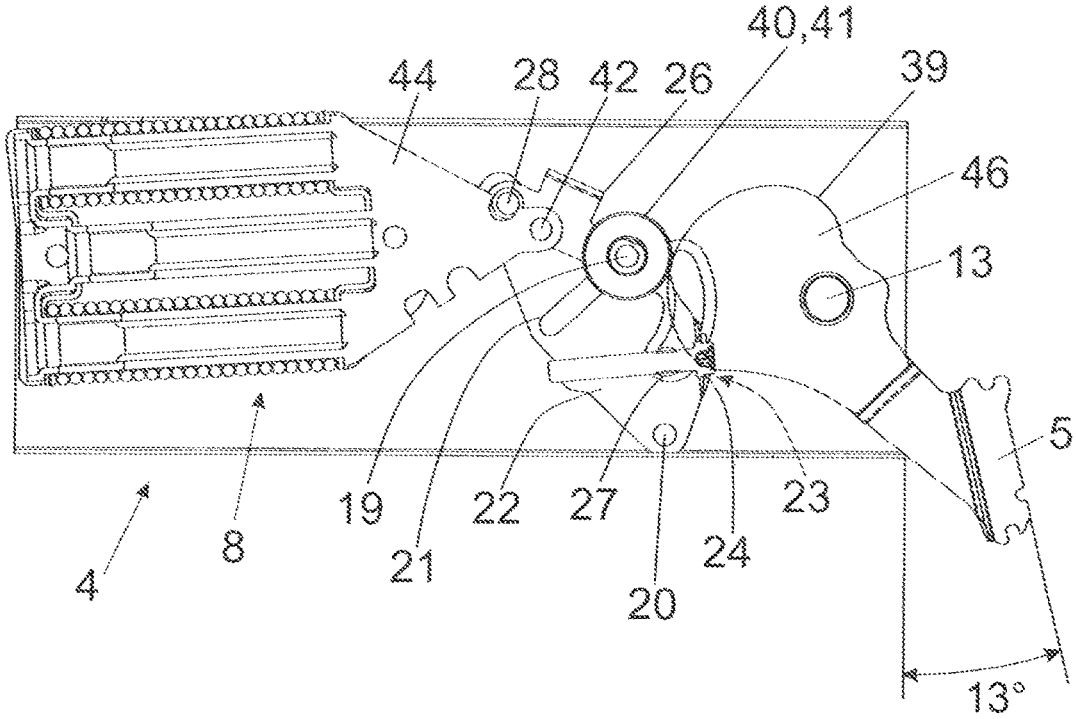

FIG. 8*a* and FIG. 8*b* show side views of the actuating drive 4 with an actuating arm 5 located in differently adjusted dead-centers. The adjustment of the actuating portion 19 relative to the guide 21 according to FIG. 8*a* corresponds to the one according to FIG. 7*a*, wherein this adjustment is provided for moving lightweight flaps 3. The spring device 8 according to FIG. 8*a* is lowly pre-stressed, the dead-center position T1 of the actuating arm 5 lies, starting from the fully closed end position of the actuating arm 5, approximately at an opening angle of 16°. By adjusting the actuating portion 19 in or along the guide 21, the position of the dead-center as well as the force of the spring device 8 acting in the opening direction can be variably adjusted which can be seen in FIG. 8*b*. The adjustment of the actuating portion 19 relative to the guide 21 is thus provided for moving heavy flaps 3. The spring device 8 according to FIG. 8*a* is more compressed, whereby the spring device 8, after having passed the dead-center position, exerts a respective high torque onto the actuating arm 5 in the opening direction, although the closing force of the actuating arm 5 in the closing position can be kept low. The dead-center position T2 of the actuating arm 5, starting from the fully closed position of the actuating arm 5, can be reduced by adjusting the actuating portion 19 along the guide 21 and lies in the shown FIG. 8*b* approximately at an opening angle of 13°. By the adjusting device 23, on the one hand the distance between the actuating portion 19 and the stationary hinge axis 20 and on the other hand the position of the moving hinge axis 28 relative to the stationary hinge axis 20 can be altered, whereby besides a varied dead-center position, also different lever ratios arise. The adjustment of the actuating portion 19 in relation to the guide 21 shown in FIG. 8*b* is provided for heavy furniture flaps 3 and corresponds to the curve D according to FIG. 1.

Figure 9:
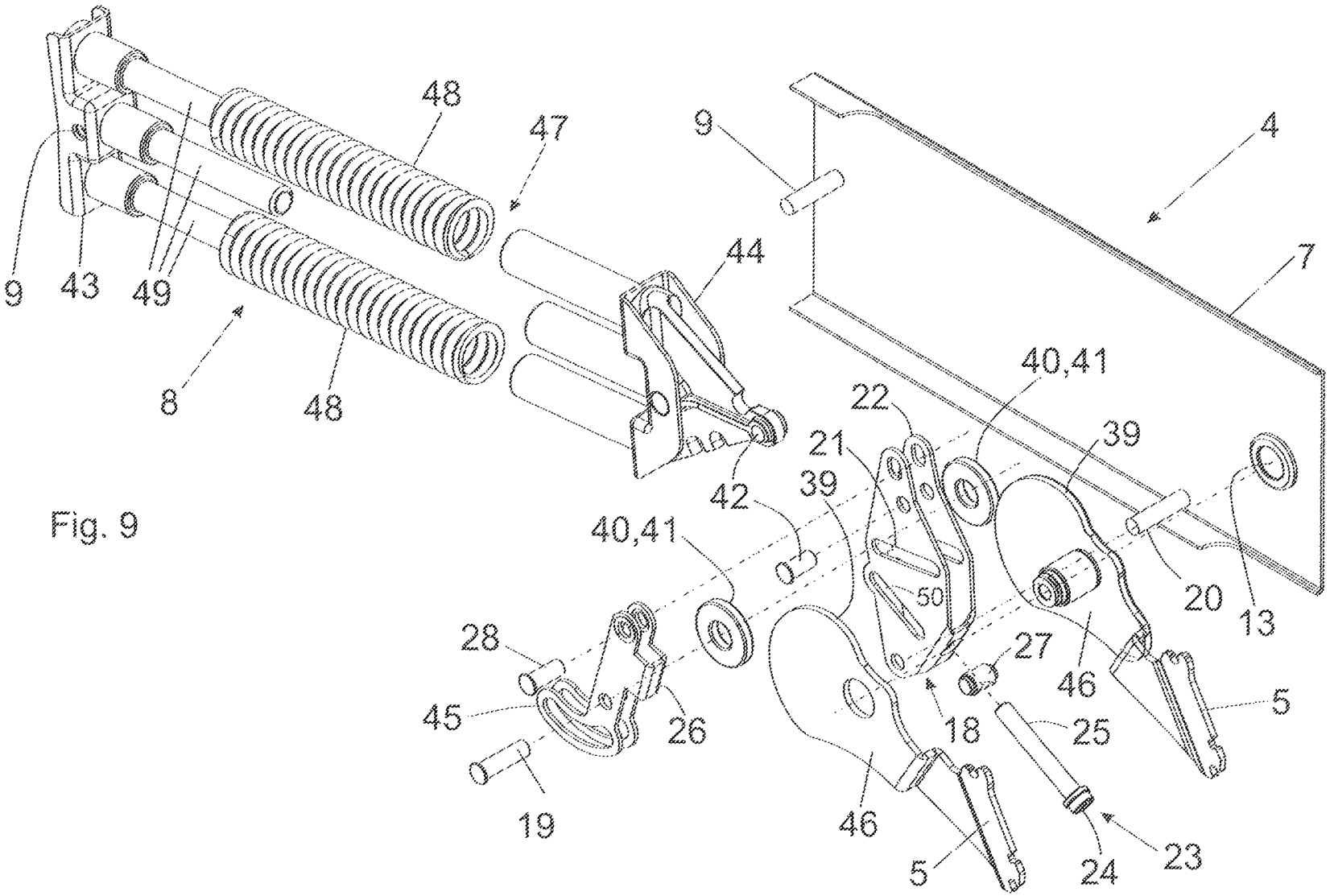
FIG. 9 is an exploded view of the actuating drive according to FIGS. 6, 7*a*, 7*b*, 8*a*, 8*b*.

FIG. 9 shows an exploded view of the actuating drive 4 according to the embodiment shown in FIGS. 6, 7*a*, 7*b*, 8*a*, 8*b*. The spring device 8 includes a spring holder 47 with a first portion 43 which is supported on the spring basis 9. The first portion 43 is provided with rods 49 which are provided for the selective and interchangeable accommodation of two or more pressure springs 48. The second portion 44 of the spring holder 47 which is acted upon by the pressure springs 48 acts onto a joint 42 on the lever 22. The lever 22 is pivotally mounted about a stationary hinge axis 20 relative to the base plate 7. On the end of the lever 22 facing away from the hinge axis 20, an adjusting lever 26 with a contour 45 is pivotally mounted about the moving axis 28, the lever 26 is provided for supporting a mounting thread 27. The mounting thread 27 has a cylindrical peripheral surface and is provided for accommodating a threaded portion 25 which can be rotated by an adjustment wheel 24 of an adjusting device 23. By rotating the adjustment wheel 24, the adjusting lever 26 can be adjusted in a direction towards and away from the adjustment wheel 24, so that also the actuating portion 19 with the pressure portions 40 in the form of pressure rollers 41 arranged on the adjusting lever 26 can be adjusted along the guide 21 arranged on the lever 22. The actuating portion 19 which can be adjusted by the adjusting device 23 is movement-coupled to the pressure roller 41, and it is preferable that the adjustable actuating portion 19 forms the pivoting axis for the rotatable roller 41. The pressure portions 40 in the form of the pressure rollers 41 are displaceably arranged along control curves 39 formed on actuating portions 46. The actuating portions 46, in the shown embodiment, are made in one piece with the actuating arms 5 and are pivotally mounted about the stationary hinge axis 13.

The invention claimed is:

1. An actuating drive for moving a flap of an item of furniture, the actuating drive comprising:

an actuating portion;

at least one actuating arm pivotally mounted about a pivoting axis for moving the flap;

a spring device for applying a force onto the actuating arm;

a transmission mechanism for transmitting a force of the spring device onto the actuating arm in a closing direction and, after exceeding a dead-center position, for transmitting a force of the spring device onto the actuating arm in an opening direction;

an adjusting device for adjusting a position of the actuating portion of the actuating drive in or along a guide;

wherein the actuating drive includes a coupling device which couples the spring device, the pivoting axis of the actuating arm, and the actuating portion to one another;

wherein the actuating portion, the actuating arm, and the spring device are configured such that, by adjusting the actuating portion in or along the guide, a position of the dead-center of the actuating arm and a force of the spring device acting towards the opening direction onto the actuating arm can be variably adjusted so that, upon an increase of the force acting towards the opening direction, a pivoting angle of the actuating arm, at which the position of the dead center lies, can be reduced;

wherein the coupling device includes at least one lever pivotally mounted about a hinge axis, the guide being arranged or formed on the lever.

2. The actuating drive according to claim 1, wherein the adjusting device is configured to variably adjust the position of the dead-center of the actuating arm, starting from the fully closed position of the actuating arm, between 10° and 30°.

3. The actuating drive according to claim 2, wherein the adjusting device is configured to variably adjust the position of the dead-center of the actuating arm, starting from the fully closed position of the actuating arm, between 15° and 25°.

4. The actuating drive according to claim 1, wherein the spring device is configured to engage the actuating portion via at least one pushing lever, and the pivoting axis of the actuating arm is coupled to the actuating portion via at least one adjusting lever, wherein by adjusting the actuating portion in or along the guide, the position of the pushing lever as well as the position of the adjusting lever relative to the lever can be variably adjusted.

5. The actuating drive according to claim 1, wherein the adjusting device is configured to adjust the position of the actuating portion in or along the guide in a direction towards and away from the hinge axis of the lever, wherein the relative distance between the actuating portion and the hinge axis of the lever can be reduced and enlarged along a notional connecting line between the actuating portion and the hinge axis of the lever.

6. The actuating drive according to claim 5, wherein the adjusting device is configured to adjust the position of the actuating portion in or along the guide in a direction transverse to the notional connecting line.

7. The actuating drive according to claim 1, wherein the spring device includes at least one coil spring.

8. The actuating drive according to claim 1, wherein the spring device includes at least one pressure spring.

9. An arrangement comprising:

a flap of an item of furniture; and the actuating drive according to claim 1, wherein the actuating drive is configured to move the flap between a vertical closed position and an open position which is arranged above a furniture carcass.

10. An actuating drive for moving a flap of an item of furniture, the actuating drive comprising:

an actuating portion;

at least one actuating arm pivotally mounted about a pivoting axis for moving the flap;

a spring device for applying a force onto the actuating arm;

a transmission mechanism for transmitting a force of the spring device onto the actuating arm in a closing direction and, after exceeding a dead-center position, for transmitting a force of the spring device onto the actuating arm in an opening direction;

an adjusting device for adjusting a position of the actuating portion of the actuating drive in or along a guide;

wherein the actuating drive includes a coupling device which couples the spring device, the pivoting axis of the actuating arm, and the actuating portion to one another;

wherein the actuating portion, the actuating arm, and the spring device are configured such that, by adjusting the actuating portion in or along the guide, a position of the dead-center of the actuating arm and a force of the spring device acting towards the opening direction onto the actuating arm can be variably adjusted so that, upon an increase of the force acting towards the opening direction, a pivoting angle of the actuating arm, at which the position of the dead center lies, can be reduced;

wherein the transmission mechanism includes a two-armed deflection lever with two lever ends, the deflection lever being pivotally mounted about a pivoting axis, wherein a first lever end interacts with the spring device and a second lever end interacts with the actuating portion; and wherein the spring device is connected to the first lever end of the deflection lever via a joint, and the joint being non-adjustably arranged relative to the pivoting axis of the deflection lever.

11. An actuating drive for moving a flap of an item of furniture, the actuating drive comprising:

an actuating portion;

at least one actuating arm pivotally mounted about a pivoting axis for moving the flap;

a spring device for applying a force onto the actuating arm;

a transmission mechanism for transmitting a force of the spring device onto the actuating arm in a closing direction and, after exceeding a dead-center position, for transmitting a force of the spring device onto the actuating arm in an opening direction;

an adjusting device for adjusting a position of the actuating portion of the actuating drive in or along a guide;

wherein the actuating drive includes a coupling device which couples the spring device, the pivoting axis of the actuating arm, and the actuating portion to one another;

wherein the actuating portion, the actuating arm, and the spring device are configured such that, by adjusting the actuating portion in or along the guide, a position of the dead-center of the actuating arm and a force of the spring device acting towards the opening direction onto the actuating arm can be variably adjusted so that, upon an increase of the force acting towards the opening direction, a pivoting angle of the actuating arm, at which the position of the dead center lies, can be reduced;

wherein the transmission mechanism includes an actuating portion movement-coupled to the actuating arm, a control curve, and a pressure portion acted upon by the spring device, the pressure portion being configured to, upon a movement of the actuating arm, be displaced along the control curve, wherein by adjusting the actuating portion in or along the guide, the position of the pressure portion can be variably adjusted.

12. The actuating drive according to claim 11, wherein the pressure portion is formed as a rotatably mounted pressure roller.

13. The actuating drive according to claim 12, wherein the actuating portion forms the pivoting axis of the pressure roller.

14. An actuating drive for moving a flap of an item of furniture, the actuating drive comprising:

an actuating portion;

at least one actuating arm pivotally mounted about a pivoting axis for moving the flap;

a spring device for applying a force onto the actuating arm;

a transmission mechanism for transmitting a force of the spring device onto the actuating arm in a closing direction and, after exceeding a dead-center position, for transmitting a force of the spring device onto the actuating arm in an opening direction;

an adjusting device for adjusting a position of the actuating portion of the actuating drive in or along a guide;

wherein the actuating drive includes a coupling device which couples the spring device, the pivoting axis of the actuating arm, and the actuating portion to one another;

wherein the actuating portion, the actuating arm, and the spring device are configured such that, by adjusting the actuating portion in or along the guide, a position of the dead-center of the actuating arm and a force of the spring device acting towards the opening direction onto the actuating arm can be variably adjusted so that, upon an increase of the force acting towards the opening direction, a pivoting angle of the actuating arm, at which the position of the dead center lies, can be reduced;

wherein the adjusting device has an adjusting wheel, wherein by rotating the adjusting wheel, the position of the actuating portion can be adjusted in or along the guide.

* * * * *